US008192070B2

(12) United States Patent
Allen

(10) Patent No.: US 8,192,070 B2
(45) Date of Patent: Jun. 5, 2012

(54) STRAIGHT THROUGH CEMENT MIXER

(75) Inventor: Thomas E. Allen, Tulsa, OK (US)

(73) Assignee: Estate of Thomas E. Allen, Tulsa, OK (US)

( * ) Notice: Subject to any disclaimer, the term of this patent is extended or adjusted under 35 U.S.C. 154(b) by 1101 days.

(21) Appl. No.: 12/052,194

(22) Filed: Mar. 20, 2008

(65) Prior Publication Data

US 2009/0190435 A1 Jul. 30, 2009

Related U.S. Application Data

(63) Continuation-in-part of application No. 12/021,415, filed on Jan. 29, 2008.

(51) Int. Cl.
*B01F 15/02* (2006.01)
*B01F 15/00* (2006.01)

(52) U.S. Cl. ..... 366/136; 366/163.2; 366/165.1; 366/177.1; 366/132; 366/137; 366/160.2; 366/173.2; 366/178.2; 366/178.3

(58) Field of Classification Search ..... 366/136, 366/160.2, 173.2, 178.2, 178.3, 163.2, 165.1, 366/177.1, 132, 137
See application file for complete search history.

(56) References Cited

U.S. PATENT DOCUMENTS

| | | | | |
|---|---|---|---|---|
| 563,978 | A | 7/1896 | Meinshausen | |
| 2,481,959 | A | 9/1949 | Wahlin | |
| 2,751,425 | A | 6/1956 | Rupp | |
| 3,298,669 | A * | 1/1967 | Zingg | 366/107 |
| 5,046,855 | A | 9/1991 | Allen et al. | |
| 5,355,951 | A | 10/1994 | Allen et al. | |
| 5,571,281 | A | 11/1996 | Allen | |
| 5,664,733 | A | 9/1997 | Lott | |
| 5,775,446 | A | 7/1998 | Lott | |
| 6,454,457 | B1 * | 9/2002 | Banse et al. | 366/136 |
| 6,749,330 | B2 | 6/2004 | Allen | |
| 6,796,704 | B1 * | 9/2004 | Lott | 366/163.2 |

* cited by examiner

*Primary Examiner* — Nathan Bowers
(74) *Attorney, Agent, or Firm* — Molly D. McKay

(57) ABSTRACT

A cement mixing method for mixing cement used in cementing oil wells casing and the mixer used in that method. The mixer employs a straight bulk cement inlet, five annular recirculation jets and five annular water jet orifices located downstream of the recirculation jets so that all of the jets discharge at an angle towards the mixing chamber and the discharge from the water jet orifices intersects with the flow from the recirculation jets. This five jet, intersecting flow design allows for more thorough wetting of the cement powder with a smaller, lighter, less expensive and more durable mixer that is less inclined to foul and easier to clean.

25 Claims, 4 Drawing Sheets

STRAIGHT THROUGH CEMENT MIXER

CROSS-REFERENCE TO RELATED APPLICATIONS

The present application is a continuation in part application of U.S. patent application Ser. No. 12/021,415 for Straight Through Cement Mixer which was filed on Jan. 29, 2008. Applicant is the sole inventor of U.S. Pat. No. 6,749,330 that issued on Jun. 15, 2004 for Cement Mixing System for Oil Well Cementing. Applicant also is sole inventor of U.S. Pat. No. 5,571,281 that issue on Nov. 5, 1996 for Automatic Cement Mixing and Density Simulator and Control System and Equipment for Oil Well Cementing; is one of the co-inventors of U.S. Pat. No. 5,355,951 that issued on Oct. 18, 1994 for Method of Evaluating Oil or Gas Well Fluid Process; and is one of the co-inventors of U.S. Pat. No. 5,046,855 that issued on Sep. 10, 1991 for Mixing Apparatus.

BACKGROUND OF THE INVENTION

1. Field of the Invention

The present invention is a high efficiency, high energy slurry mixer used primarily to mix oil field cement in a recirculating system for cementing the casing in oil and gas wells. The cement mixer mixes dry powder with water and recirculated slurry to create the cement mixture. The cement mixer employs a straight through design that is easier to clean than previous designs and which can be seen straight through when the connection at the dry powder inlet is removed from the mixer. The cement mixer also has increased number and volume of annular water flow openings and recirculation openings which allows for more water and slurry flow with less erosion to the mixer surface than previous designs. The previous design did not allow for more recirculation and water jets because there was not room to add them. The new design allows the mixer surfaces to be manufactured with less expensive materials without sacrificing performance and life, thereby reducing the cost of the equipment. The present design eliminates most of the wear problems experienced in earlier designs resulting in the equipment lasting longer before repair or replacement is required.

2. Description of the Related Art

The discussion regarding related art appearing in U.S. Pat. No. 6,749,330 is hereby included by reference. The cement mixer design taught in U.S. Pat. No. 6,749,330 had several problems. First, the earlier mixer was not of a straight through type. That earlier mixer included $1^{st}$ and $2^{nd}$ elbows (associated with reference numerals 114 and 116 in the patent) in the central recirculation line 54, and included a curved inlet 52 for the dry bulk cement.

Because of this design, it was more difficult to flush out and clean the inside of the mixer. Also, it was not possible to see straight through the mixer by breaking open the piping connection at the inlet 52, thus making it more difficult to see inside the mixer to troubleshoot or determine if it was clean when doing maintenance.

Further, the central recirculation line of that earlier mixer was just one additional surface which could be eroded by the abrasive recirculated cement slurry contained within its interior.

Also, the four annular water jets of the earlier mixer had less flow capacity, resulting in higher velocity of liquid streams within the mix chamber to obtain comparable flow rates and thus more erosion of the interior mixer surfaces due to the abrasion caused by the abrasive sand in dirty mix water. Additionally, the earlier mixer employed a somewhat complicated design having multiple passageways, all of which are susceptible to erosion by the dirty mix water. The erosion resulted in more equipment maintenance and shorter equipment life. In an attempt to protect the earlier mixer from erosion, some of the surfaces were either hard coated or constructed of heat treated stainless steel which added to the cost of the equipment.

The present invention addresses each of these problems.

One object of the present invention is to provide a straight through design without any internal centrally located recirculation or water jet pipes that is less inclined to foul and easier to clean than previous designs. Also, this straight design allows the mix chamber of the present invention to be viewed when the connection at the dry powder inlet is broken.

A second object of the present invention is to eliminate the need for a central recirculation line by having more complete coverage in the mixing chamber by employing more annular jets.

An additional object of the present invention is to provide a mixer that employs recirculation jets located upstream of its water jets A further object of the present mixer is to increase the number and capacity of the annular water flow openings thereby allowing greater water flows with less velocity. The path of recirculation and water flows is such that they do not directly impact the mixer sides and they cause less erosion to the mixer surface than with previous designs. Another object of the present invention is to provide a high performance mixer that has less internal erosion.

A further object of the present invention is to provide a mixer that can be manufactured with lesser expensive materials to thereby reduce the manufacturing cost of the mixer.

A further object of the present invention is to provide a mixer that is less complex in design and therefore reducing manufacturing cost and simplifying maintenance.

Still a further object of the present invention is to provide a mixer that, due to the reduced erosion, will have a longer life and required less maintenance than previous designs. Also disassembly and repair is much simpler with this design. Another object of the present invention is to provide a smaller, more compact and lighter weight cement mixer.

An additional object of the present invention is to provide a five jet design which allows for more recirculation jets and more water jets than previous designs, resulting in more thorough mixing and better wetting of the cement powder.

An additional object is to have the recirculation jets extending into the dry bulk chamber so as to form a star shape in the bulk inlet chamber which serves to help break up or disperse the incoming dry powder.

These and other objects will become more apparent upon further review of the referenced drawings, detailed description, and claims submitted herewith.

SUMMARY OF THE INVENTION

The present invention is a cement mixing method and a mixer used in that method for mixing cement that will be used in cementing oil well casings. The mixer is of the "recirculating" type with variable high pressure water jets. Typically, this type of mixer discharges cement slurry from its outlet end into a diffuser and then into a mixing tank. A recirculation pump is attached to the mixing tank that circulates the already mixed slurry contained in the mixing tank back to recirculation flow inlets provided on the mixer to provide more mixing energy and to provide an opportunity to sample the slurry density. Also typically a mix water pump is connected to a supply of mix water and pumps mix water to a mix water inlet provided on the mixer. The mix water inlet supplies mix water to water jets in the mixer. The water jets control the mixing rate and add mixing energy. Bulk cement is added at the dry bulk cement inlet of the mixer. In general, most of the currently used cement slurry mixers have the above characteristics, some doing a better job than others. The present invention is for use in the same type of environment and in association with the same type of equipment as the mixer taught in U.S. Pat. No. 6,749,330 and the teaching regarding associated equipment from that patent is hereby included by reference.

Beginning at the inlet end or upstream end of the mixer and moving toward the outlet end or downstream end of the mixer, the mixer is provided at its inlet end with a straight bulk cement inlet for admitting dry powder cement into a mixing chamber that is located internally within the mixer housing.

Adjacent to and downstream of the dry bulk cement inlet, the mixer is provided with two recirculation flow inlets that both communicate with a recirculation manifold. The recirculation manifold supplies recirculated cement slurry to five annular recirculation jets that are located around the inside of the mixing chamber downstream of the bulk inlet chamber and the dry bulk cement inlet. For purposes of clarity, the interior of the mixer will be described as being divided into two areas: the bulk inlet chamber and the mixing chamber. The first area is the bulk inlet chamber which extends from the inlet to the recirculation jets. The second area is the mixing chamber which extends from the recirculation jets to the outlet of the mixer. Each recirculation jet or outlet is defined by two structures within the mixer. One structure is the common wall that separates the bulk inlet chamber from the recirculation jets and the other structure is the common wall that separates the recirculation jets from the mix water manifold. The recirculation outlets discharge inwardly at an angle into the mixing chamber.

Adjacent to the recirculation flow inlet, the mixer is provided with a mix water inlet. The mix water inlet communicates with a water manifold that supplies water to five annular water jet orifices provided within the mixing chamber downstream of the recirculation jets. The mix water manifold is defined by three structures within the mixer. One structure is the common wall that separates the recirculation manifold from the mix water manifold. A second structure is the outer housing for the mixer, and a third structure is a rotatable flow adjustment plate of a water metering valve. Grooves are provided in the surfaces that are adjacent to the rotatable water metering valve element to accommodate pressure face seals to contain water pressure within the mix water manifold. A groove is also provided in a fixed orifice plate for a radial seal to secure the fixed orifice plate to the mixer housing so that fluid does not leak out of the mixing chamber at the junction where the fixed orifice plate is secured to the housing.

As shown in FIG. 3, spacers that are slightly larger in thickness than the rotatable flow adjustment plate are provided surrounding the rotatable flow adjustment plate to allow the flow adjustment plate sufficient clearance between the wall of the water manifold and the fixed orifice plate so that the flow adjustment plate can be rotated. The mixer is provided with a mix water adjustment input means consisting of a fixed orifice plate containing the annular water jet orifices and rotatable or movable water meter valve element or flow adjustment plate with cut away openings therethrough. The movable flow adjustment plate is located adjacent to the fixed orifice plate and between the water manifold and the fixed orifice plate. The movable flow adjustment plate is provided with a handle for rotating the movable flow adjustment plate relative to the fixed orifice plate.

The fixed orifice plate and the rotatable flow adjustment plate cooperate to control the flow of water through the water jet orifices. The position of the movable flow adjustment plate relative to the fixed orifice plate controls the flow of water through the five annular water jets by more fully aligning the cut away openings of the movable flow adjustment plate with the metering slots of the fixed orifice plate, or alternately, by moving the openings more completely out of alignment with the slots. As the movable flow adjustment plate is rotated in a counter clockwise direction, the cut away openings of the moveable flow adjustment plate move so that they align longitudinally within the mixer more completely with their corresponding annular water jet orifices provided in the fixed orifice plate to allow more water to pass from the water manifold through the openings and slots in the movable and fixed orifice plates and out the annular water jet orifices into the mixing chamber of the mixer. Alternately, when the moveable flow adjustment plate is rotated in a clockwise direction, the cut away openings of the moveable flow adjustment plate move out of alignment longitudinally within the mixer with their corresponding annular water jet orifices provided in the fixed orifice plate to allow less water to pass from the water manifold through the movable flow adjustment plates and the fixed orifice plates and out the annular water jet orifices into the mixing chamber of the mixer.

The water jet orifices are angled in orientation so that their discharge is directed inwardly towards the mixing chamber. All of the existing technology with annular adjustable orifices is aligned in an axial direction. These axial designs require the flow direction to be "turned" or deflected beyond the jet to hit the desired mixing chamber location. The turning of high velocity flow causes high wear on mixer parts.

Also, the water jets are located axially downstream of the recirculation jets. This allows for more compact construction, much lower production cost, and easier maintenance.

The five annular recirculation jets are located axially upstream within the mixing chamber relative to the five annular water jets so that the recirculation jets discharge into the mixing chamber upstream of the discharge from the annular water jets. The five jet design allows for more recirculation jets and more water jets than previous designs, resulting in more thorough mixing (better wetting of powder).

The mixer employs equal numbers of recirculation jets and water jets and so that the numbers of each type of jets are balanced. Although odd numbers of recirculation and water jets are preferred, even numbers of these jets are also possible.

The evenly spaced water jets deliver mix water annularly to the mixing chamber downstream of where the recirculation jets deliver recirculation flow annularly to the mixing chamber. This arrangement is important for several reasons. The location of the water jets tends to intersect with and further mix the slurry which was introduced upstream in the mixing chamber, thus enhancing mixing. Existing technology with annular adjustable orifices alternate rather than intersect the discharge from the recirculation jet flow. Also, the location of the water jets downstream of the recirculation jets also tends to protect the internal surfaces of the mixing chamber from abrasion by the sand and grit contained in the recirculated cement slurry flowing out of the recirculation jets or by sand contained in unclean water flowing out of the water jets when the water source is unclean.

Finally, an outlet for the mixer is provided at the outlet end of the mixer. The mixture of cement leaves the mixing chamber of the mixer through the outlet.

DETAILED DESCRIPTION OF THE PREFERRED EMBODIMENT

Figure 2:
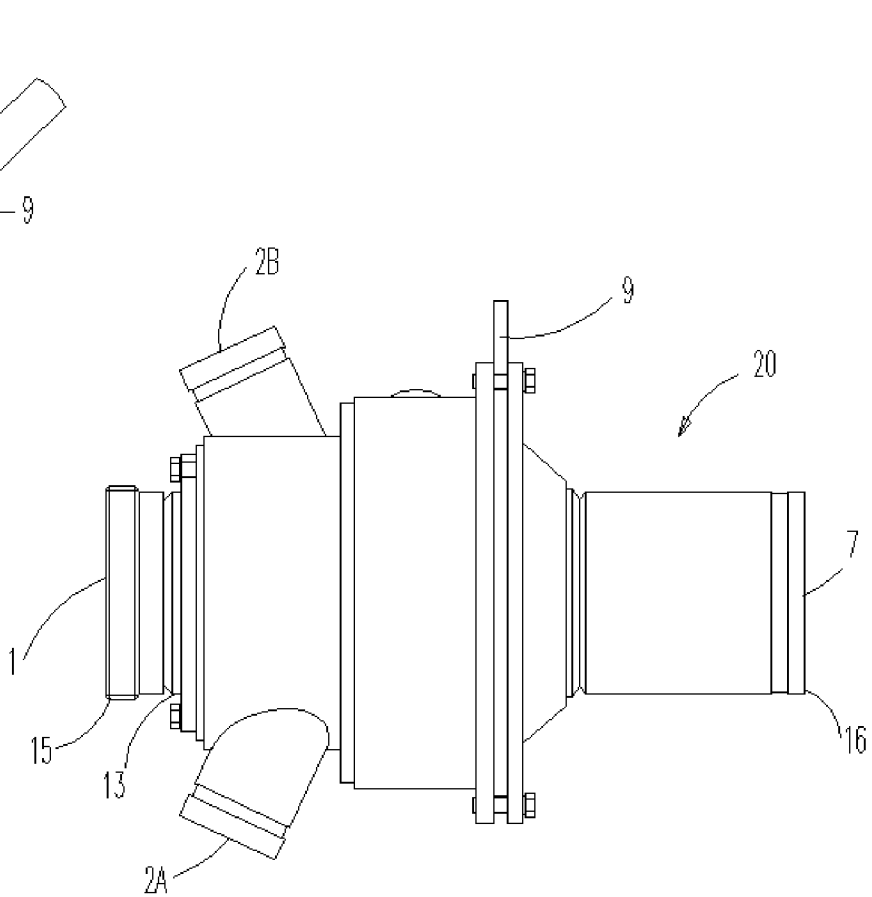
FIG. 2 is a right side view of the cement mixer of FIG. 1.
Figure 3:
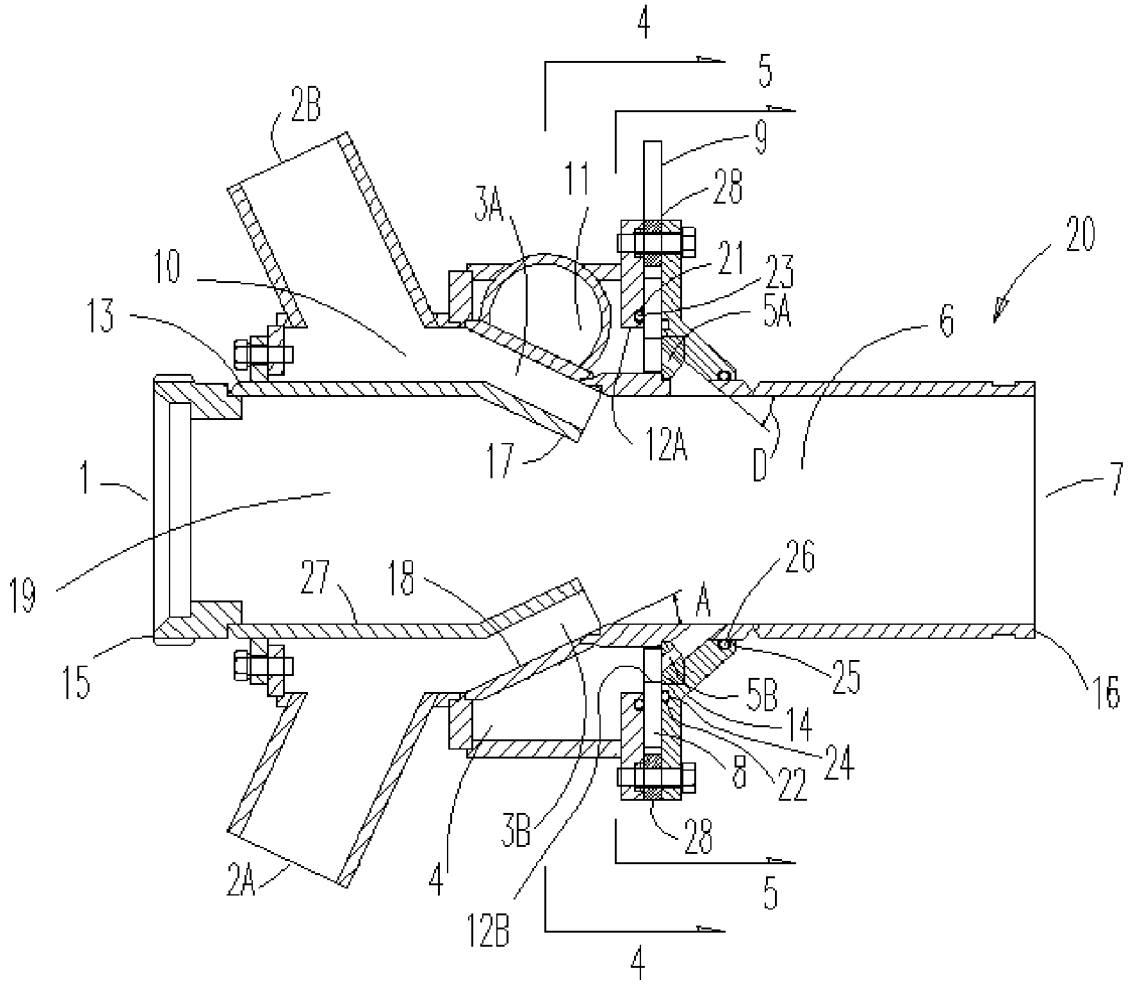
FIG. 3 is a cross sectional view taken along line 3-3 of FIG. 1.

Referring now to the drawings and initially to FIGS. 2 and 3, the present invention is a cement mixing method and the mixer 20 used in that method for mixing cement that will be used in cementing oil wells. The overall typical system and equipment within which the mixer 20 is likely to be used are taught in U.S. Pat. No. 6,749,330. That teaching is incorporated herein by reference.

As explained in detail in U.S. Pat. No. 6,749,330, typically a cement mixer discharges from its outlet end into a diffuser and subsequently into a mixing tank. A recirculation pump is attached to the mixing tank and recirculates the contents of the mixing tank to recirculation flow inlets provided on the mixer. And, typically a mix water pump is connected to a supply of mix water and pumps that mix water to a mix water inlet provided on the mixer. Also, bulk cement is pneumatically delivered to the dry bulk cement inlet of the mixer. It is the cement mixer 20 that is the subject of the present invention. A preferred embodiment of the invention is shown in the attached drawings and will be more fully described hereafter.

Referring to FIG. 3, the mixer 20 is shown in cross sectional view. For purposes of clarity, the interior of the mixer 20 will be described as being divided into two areas: a bulk inlet chamber 19 and a mixing chamber 6. The first area is the bulk inlet chamber 19 which extends from the inlet 1 to the recirculation jets 3A, 3B, 3C, 3D and 3E. The bulk inlet chamber 19 receives the dry powder cement from the inlet 1 and conveys it to the second area which is the mixing chamber 6. No mixing occurs in the bulk inlet chamber 19. The mixing chamber 6 extends from the recirculation jets 3A, 3B, 3C, 3D and 3E to the outlet 7 of the mixer 20 and it is in the mixing chamber 6 where the cement powder is mixed with the recirculated slurry and mix water.

The mixer 20 is provided at its inlet end 15 with a straight bulk cement inlet 1 for admitting dry powder cement into the bulk inlet chamber 19 located internally within the mixer housing 13 and then into the mixing chamber 6 which is also located internally within the mixer housing 13. Adjacent to the dry bulk cement inlet 1 are two recirculation flow inlets 2A and 2B that both communicate with a recirculation manifold 10 that supplies recirculated cement slurry to five annular recirculation jets 3A, 3B, 3C, 3D and 3E located annually around the inside of the mixing chamber 6. Adjacent to the recirculation flow inlets 2A and 2B is a mix water inlet 11 that communicates with a mix water manifold 4 that supplies water to five annular water jets or jet orifices 5A, 5B, 5C, 5D and 5E provided within the mixing chamber 6 downstream of the five annular recirculation jets 3A, 3B, 3C, 3D and 3E.

The water manifold 4 has a mix water adjustment output means consisting of a fixed orifice plate 14 containing the annular water jet orifices 5A, 5B, 5C, 5D and 5E and a rotatable or movable water meter valve element or flow adjustment plate 8 with cut away openings 12A, 12B, 12C, 12D and 12E therethrough. The movable flow adjustment plate 8 is provided with a handle 9 for rotating it in order to control the flow of mix water passing through the five annular water jets 5A, 5B, 5C, 5D and 5E. At an outlet end 16 of the mixer 20 is an outlet 7 that discharges the cement mixture from the mixing chamber 6 of the mixer 20. The details of all of these features will be described in more detail hereafter beginning at the inlet end 15 of the mixer 20 and moving toward the opposite outlet end 16 of the mixer 20.

Figure 1:
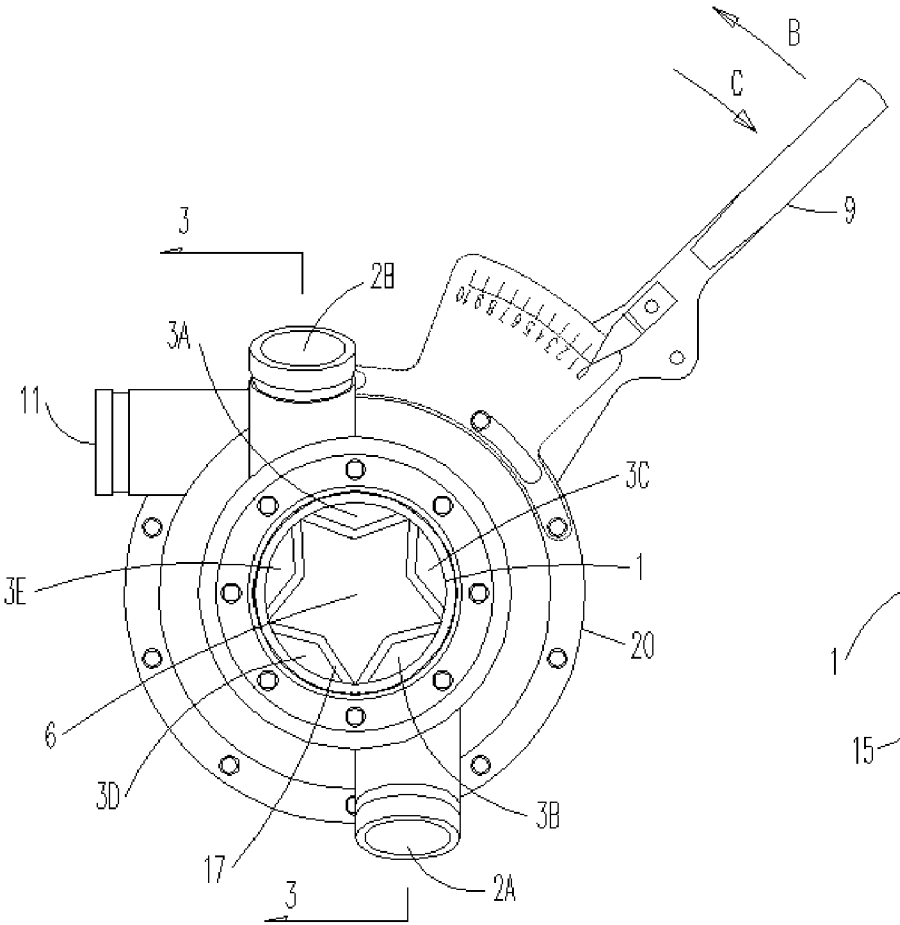
FIG. 1 is an inlet end view of a cement mixer constructed according to a preferred embodiment of the present invention.

Beginning at the inlet end 15 of the mixer 20, the mixer 20 is provided with a straight bulk cement inlet 1 for admitting dry powder cement into the mixing chamber 6 that is located internally within the mixer housing 13. The straight bulk cement inlet 1 permits an unobstructed view inside and through both the bulk inlet chamber 19 and the mixing chamber 6 of the mixer 20 when piping that is normally connected with the inlet 1 is disconnected therefrom, as best illustrated in FIG. 1. Also, this straight design allows for easier cleaning and inspection of both the bulk inlet chamber 19 and the mixing chamber 6.

Referring now to FIGS. 1, 2 and 3, adjacent the dry bulk cement inlet 1, the mixer 20 is provided with the two recirculation flow inlets 2A and 2B that both communicate with the recirculation manifold 10. The recirculation manifold 10 supplies recirculated cement slurry to five annular recirculation jets 3A, 3B, 3C, 3D and 3E that are located around the inside of the mixing chamber 6. Each recirculation jet or outlet 3A, 3B, 3C, 3D and 3E is defined by two structures 17 and 18 within the mixer 20. The first structure is the common wall 17 that separates the bulk inlet chamber 19 from the recirculation jets 3A, 3B, 3C, 3D and 3E, and the second structure is the common wall 18 that separates the recirculation jets 3A, 3B, 3C, 3D and 3E from the mix water manifold 4. The recirculation jets 3A, 3B, 3C, 3D and 3E discharge at an angle A into the mixing chamber 6.

Figure 4:
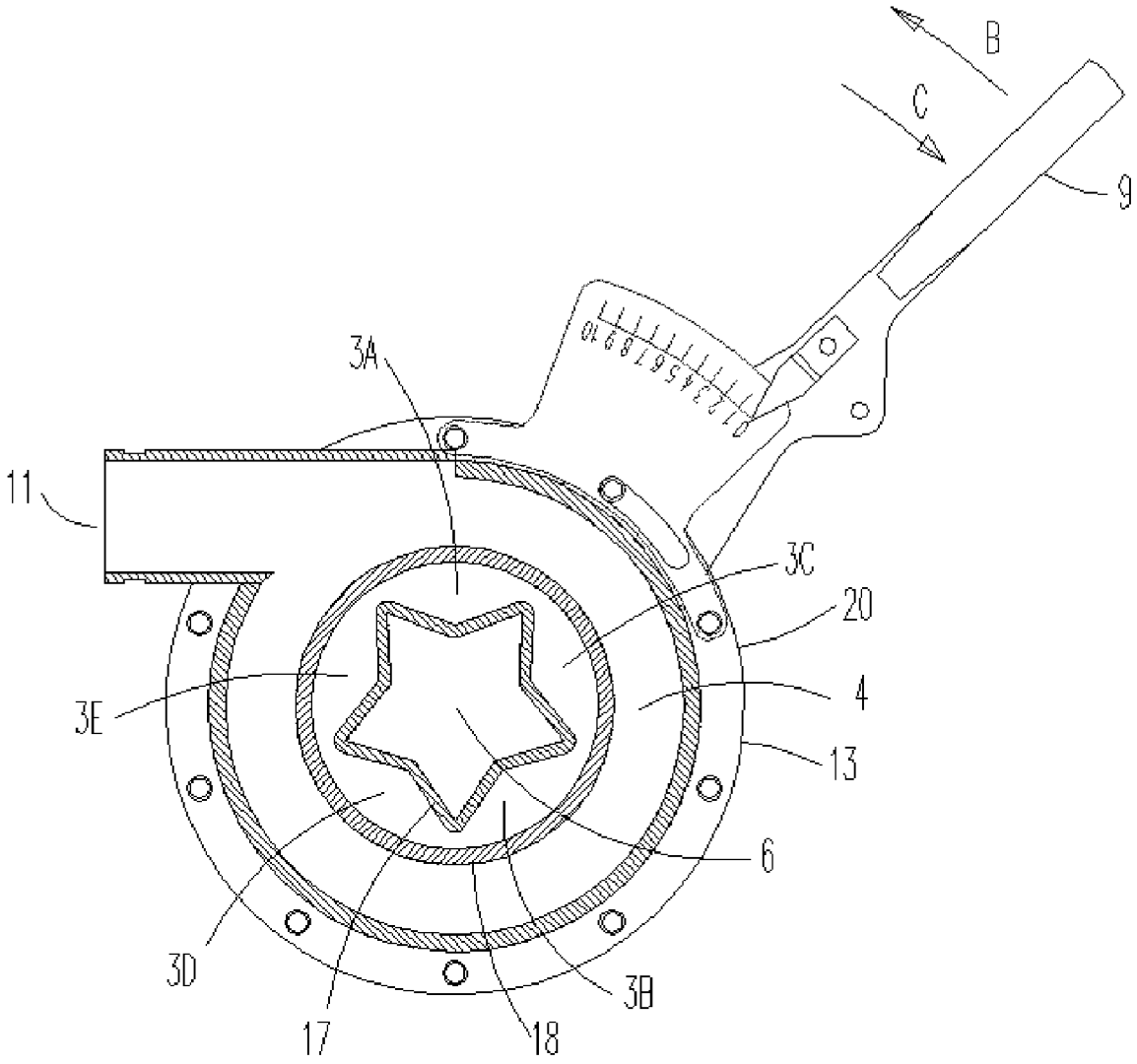
FIG. 4 is a cross sectional view taken along line 4-4 of FIG. 3 showing the mix water manifold and the star like appearance of the recirculation jets when viewed from this perspective.

Referring to FIGS. 3 and 4, adjacent to the recirculation flow inlets 2A and 2B, the mixer 20 is provided with the mix water tangential inlet 11. It is important that the inlet 11 be tangential relative to the water manifold 4 as water is then supplied tangentially to the water manifold 4. The mix water inlet 11 communicates with the water manifold 4 that supplies water to the five annular water jet orifices 5A, 5B, 5C, 5D and 5E provided within the mixing chamber 6. By supplying the mix water tangentially to the water manifold 4, the water is supplied so that it approaches the metering openings and metering slots 12A-E and 5A-E in a uniform manner, i.e. in the same direction, thus creating equal flow characteristics therethrough for all metering openings and metering slots 12A-E and 5A-E.

Figure 5:
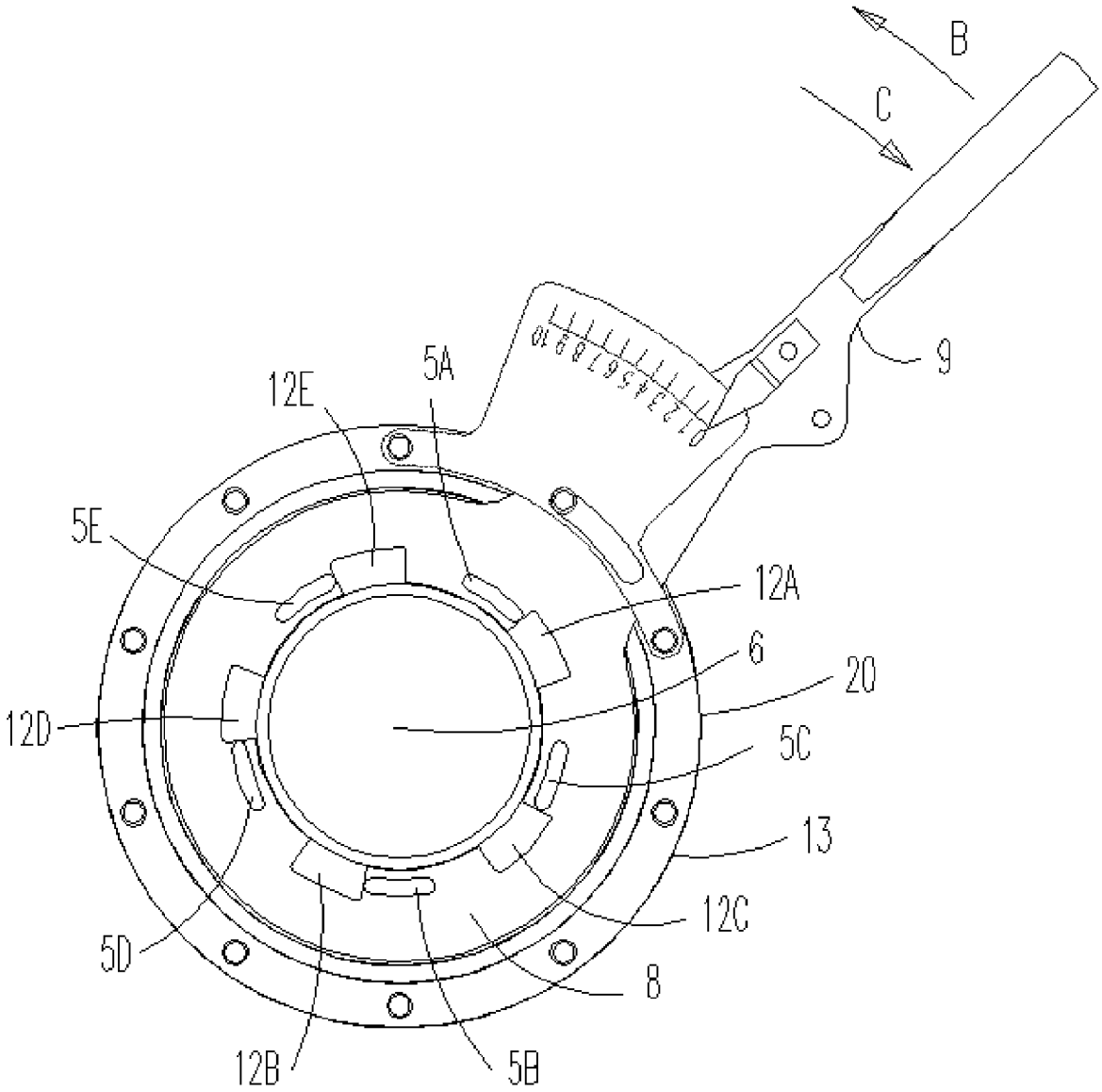
FIG. 5 is a cross sectional view taken along line 5-5 of FIG. 3 showing the rotatable flow adjustment plate.

Referring to FIGS. 3 and 5, the mix water manifold 4 is defined by three structures 18, 13 and 8 within the mixer 20. The first structure is the common wall 18 that separates the recirculation jets 3A, 3B, 3C, 3D and 3E from the mix water manifold 4. The second structure is the outer mixer housing 13 for the mixer 20, and the third structure is the rotatable flow adjustment plate 8. Grooves 21 and 22 are provided in the surfaces that are adjacent to the rotatable water metering valve element 8 to accommodate pressure face seals 23 and 24 to contain water pressure within the mix water manifold 4. A groove 25 is also provided in the fixed orifice plate 14 for a radial seal 26 to seal the fixed orifice plate 14 to the housing 13 of the mixer 20 so that fluid does not leak out of the mixing chamber 6 between the fixed orifice plate 14 and the housing 13.

As shown in FIGS. 3 and 5, the mixer 20 is provided with a mix water adjustment input means consist of the fixed orifice plate 14 which contains the annular water jet orifices 5A, 5B, 5C, 5D and 5E and the rotatable or movable water meter valve element or flow adjustment plate 8 with cut away openings 12A, 12B, 12C, 12D and 12E therethrough. The movable flow adjustment plate 8 is located adjacent to the fixed orifice plate 14 and between the water manifold 4 and the fixed orifice plate 14. As shown in FIG. 3, spacers 28 that are slightly larger in width than the rotatable flow adjustment plate 8 are provided surrounding the rotatable flow adjustment plate 8 to allow the flow adjustment plate 8 sufficient clearance between the wall of the water manifold 4 and the fixed orifice plate 14 so that the flow adjustment plate 8 can be rotated. The movable flow adjustment plate 8 is provided with a handle 9 for rotating the movable flow adjustment plate 8 relative to the fixed orifice plate 14.

The fixed orifice plate 14 and the rotatable flow adjustment plate 8 cooperate to control the flow of water through the water jet orifices 5A, 5B, 5C, 5D and 5E. The position of the movable flow adjustment plate 8 relative to the fixed orifice plate 14 controls the flow of water through the five annular water jets 5A, 5B, 5C, 5D and 5E by more fully aligning the cut away openings 12A, 12B, 12C, 12D and 12E of the movable flow adjustment plate 8 with the metering slots 5A, 5B, 5C, 5D and 5E of the fixed orifice plate 14, or alternately, by moving the cut away openings 12A, 12B, 12C, 12D and 12E more completely out of alignment with the slots 5A, 5B, 5C, 5D and 5E. As the movable flow adjustment plate 8 is rotated in a counter clockwise direction, as indicated by Arrow B in FIG. 4, the cut away openings 12A, 12B, 12C, 12D and 12E of the moveable flow adjustment plate 8 move so that they align longitudinally within the mixer 20 more completely with their corresponding annular water jet orifices 5A, 5B, 5C, 5D and 5E provided in the fixed orifice plate 14. This allows more water to pass from the water manifold 4 through the aligned portions of the openings 12A, 12B, 12C, 12D and 12E and slots 5A, 5B, 5C, 5D and 5E and into the mixing chamber 6. Alternately, when the moveable flow adjustment plate 8 is rotated in a clockwise direction, as indicated by Arrow C in FIG. 4, the cut away openings 12A, 12B, 12C, 12D and 12E of the moveable flow adjustment plate 8 moves more out of alignment longitudinally within the mixer 20 with their corresponding annular water jet orifices 5A, 5B, 5C, 5D and 5E. This allows less water to pass from the water manifold 4 through the movable flow adjustment plates and fixed orifice plates 8 and 14 and out into the mixing chamber 6. The water jets 5A, 5B, 5C, 5D and 5E discharge at an angle D into the mixing chamber 6.

The five annular recirculation jets 3A, 3B, 3C, 3D and 3E are located longitudinally upstream within the mixing chamber 6 relative to the five annular water jet 5A, 5B, 5C, 5D and 5E so that the recirculation jets 3A, 3B, 3C, 3D and 3E discharge into the mixing chamber 6 upstream of the discharge from the water jets 5A, 5B, 5C, 5D and 5E. The evenly spaced water jets 5A, 5B, 5C, 5D and 5E deliver mix water annularly to the mixing chamber 6 downstream of where the evenly spaced recirculation jets 3A, 3B, 3C, 3D and 3E deliver recirculation flow annularly to the mixing chamber 6. This arrangement is important for several reasons. The location of the water jets 5A, 5B, 5C, 5D and 5E tends to intersect with and further mix the slurry which was introduced upstream in the mixing chamber 6, thus enhancing mixing. Existing technology with annular adjustable orifices alternate rather than intersect the discharge from the recirculation jet flow. Also, the location of the water jets 5A, 5B, 5C, 5D and 5E downstream of the recirculation jets 3A, 3B, 3C, 3D and 3E also tends to protect the internal surfaces of the mixing chamber 6 from abrasion by the sand and grit contained in the recirculated cement slurry flowing out of the recirculation jets 3A, 3B, 3C, 3D and 3E or by sand contained in unclean water flowing out of the water jets 5A, 5B, 5C, 5D and 5E when the water source is unclean. Referring to FIGS. 1, 3 and 4, the five recirculation jets 3A, 3B, 3C, 3D and 3E are arranged in such a way as to create a "star" arrangement in the inner casing 17 which is the common wall between the bulk inlet chamber 19 and the five recirculation jets 3A, 3B, 3C, 3D and 3E. By having the inner casing 17 in a "star" arrangement and extending inside and inwardly beyond the normal parallel walled casing ID, as indicated by numeral 27 in the drawings, this helps to reshape the configuration of the dry bulk powder into a "star" shape as it flows through the bulk inlet chamber 19 and enters the mixing chamber 6 before it is hit with flow from the recirculation jets 3A, 3B, 3C, 3D and 3E. The resulting "star" shape of the flow of powder tends to assist in splitting or breaking up the flow of dry bulk cement coming through the casing ID, thus enhancing the wetability of the bulk cement.

Finally, as shown in FIGS. 2 and 3, the outlet 7 for the mixer 20 is provided at the outlet end 16 of the mixer 20. The mixture of cement leaves the mixing chamber 6 of the mixer 20 through the outlet 7.

Although the invention has been described as having five recirculation jets 3A, 3B, 3C, 3D and 3E and five water jets 5A, 5B, 5C, 5D and 5E, the invention is not so limited. In fact the invention can be provided with only three recirculation jets and only three water jets, or alternately, with seven of each.

The invention can alternately be provided with even numbers of both recirculation jets and water jets. The important thing is that the water jets are located downstream in the mixing chamber 6 from the associated recirculation jets so that the flow from the water jet intersects with the flow from its associated recirculation jet. The preferred arrangement is where there is the same number of recirculation jets as water jets and where there are odd numbers of each type of jets, i.e. three, five, seven, etc. of each of the recirculation jets and water jets. For example, a smaller mixer might employ only three recirculation jets and three water jets, while a larger mixer might employ seven recirculation jets and seven water jets.

Operation

Dry bulk cement powder is pneumatically blown straight into the mixer 20 at straight dry bulk cement inlet 1. As the dry bulk cement passes through the mixer's internal bulk inlet chamber 19 and subsequently into the mixing chamber 6, it is intercepted by flow of recirculated cement slurry flowing from the five recirculation jets 3A, 3B, 3C, 3D and 3E. The interception of the dry bulk cement by the recirculated slurry is the first step in wetting the cement powder. A short distance later (milliseconds in time) and downstream within the mixing chamber 6, the five water jets 5A, 5B, 5C, 5D and 5E intersect the partially wetted cement.

The mixing energy imparted by the recirculation jets 3A, 3B, 3C, 3D and 3E and the water jets 5A, 5B, 5C, 5D and 5E is very high. The high energy of all ten jets, i.e. five recirculation jets 3A, 3B, 3C, 3D and 3E and five water jets 5A, 5B, 5C, 5D and 5E, creates a well mixed slurry where all particles are wetted. The recirculation rate is constant and typically 20 bbl/min. The water flow is adjusted by rotating the flow adjustment plate 8. FIG. 4 shows the flow adjustment plate 8 with the cut away openings 12A, 12B, 12C, 12D and 12E and metering slots 5A, 5B, 5C, 5D and 5E. As the flow adjustment plate 8 is moved counter clockwise, i.e. in the direction indicated by Arrow B, the metering slots 5A, 5B, 5C, 5D and 5E are uncovered so that liquid flows therethrough. The flow rate is approximately proportional to the rotation of the flow adjustment plate 8. Typical pressure is 125 psi and maximum flow might be in the range of 10 bbl/min. The thoroughly wetted and mixed cement slurry exits the mixing chamber 13 via the outlet 7 and flows to the mixing tank, as previously described above for a typical equipment arrangement.

Although the invention has been described for use in mixing cement for oil or gas wells, the invention is not so limited and can be used to mix a variety of bulk powders into a solution. Also, the usage of this invention is not limited to the oil and gas industry, but could be used in other industries where dry bulk powders must be mixed into a solution, such as for example the food preparation industry.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A powder mixer for mixing a dry powder with liquid comprising:

a powder mixer having a dry bulk powder inlet provided at one end of the mixer, said inlet communicating with a bulk inlet chamber and subsequently with a mixing chamber provided within the powder mixer, said mixing chamber communicating with an outlet provided at an opposite end of the mixer, recirculation jets provided annularly and discharging into said mixing chamber, and water jets provided annularly, said water jets provided with metering orifices that are directed inward into said mixing chamber in an unobstructed and non-axial orientation so that water exiting from the water jets via the metering orifices does not impinge on any other structure as it enters the mixing chamber, wherein said water jets are provided downstream of the recirculation jets.

2. A powder mixer for mixing a dry powder with liquid according to claim 1 further comprising:

a water manifold attached to and supplying water to said water jets.

3. A powder mixer for mixing a dry powder with liquid according to claim 2 further comprising:

a tangential water inlet attached to and supplying water to said water manifold.

4. A powder mixer for mixing a dry powder with liquid according to claim 1 further comprising:

said recirculation jets extending into the bulk inlet chamber to form a regular star polygon configuration in the mixing chamber.

5. A powder mixer for mixing a dry powder with liquid according to claim 1 further comprising:

said water jets are adjustable.

6. A powder mixer for mixing a dry powder with liquid comprising:

a powder mixer having a dry bulk powder inlet provided at one end of the mixer, said inlet communicating with a bulk inlet chamber and subsequently with a mixing chamber provided within the powder mixer, said mixing chamber communicating with an outlet provided at an opposite end of the mixer, recirculation jets provided annularly and discharging into said mixing chamber, adjustable water jets provided annularly and discharging non-axially into said mixing chamber downstream of the recirculation jets, said water jets provided with metering orifices that are directed inwardly relative to said mixing chamber so that water from the water jets enters the mixing chamber unobstructed in a non-axial orientation without impinging on any other structure, wherein said water jets are provided downstream of the recirculation jets immediately after.

7. A powder mixer for mixing a dry powder with liquid according to claim 6 further comprising:

said recirculation jets extending into the bulk inlet chamber to form a regular star polygon configuration in the mixing chamber.

8. A powder mixer for mixing a dry powder with liquid according to claim 7 wherein an exterior surface of a wall of the inlet chamber forms one boundary of a recirulation manifold and said recirculation jets.

9. A powder mixer for mixing a dry powder with liquid according to claim 8 wherein a water manifold shares a common wall with part of said recirculation manifold and said recirculation jets.

10. A powder mixer for mixing a dry powder with liquid comprising:

a powder mixer having a dry bulk powder inlet provided at one end of the mixer, said inlet communicating with a bulk inlet chamber and subsequently with a mixing chamber provided within the powder mixer, said mixing chamber communicating with an outlet provided at an opposite end of the mixer, recirculation jets provided annularly and discharging into said mixing chamber, said recirculation jets extending into the bulk inlet chamber to form a regular star polygon configuration in the mixing chamber, adjustable water jets provided annularly and discharging water into said mixing chamber non-axially, and said water jets directed inwardly within said mixing chamber, and said water jets provided with metering orifices that are directed inwardly relative to said mixing chamber so that water exiting from the water jets enter the mixing chamber unobstructed in a non-axial orientation without impinging on any other structure, wherein said water jets are provided downstream of the recirculation jets.

11. A powder mixer for mixing a dry powder with liquid according to claim 10 wherein an exterior surface of a wall of the inlet chamber forms one boundary of the recirculation manifold and recirculation jets.

12. A powder mixer for mixing a dry powder with liquid according to claim 10 further comprising:

said inlet being straight so that it forms a straight path into said mixing chamber.

13. A powder mixer for mixing a dry powder with liquid according to claim 12 wherein an exterior surface of a wall of the inlet chamber forms one boundary of the recirculation manifold and recirculation jets.

14. A powder mixer for mixing a dry powder with liquid according to claim 12 wherein the recirculation jets extend into the bulk inlet chamber.

15. A powder mixer according to claim 12 wherein said recirculation jets converge inwardly within the mixing chamber to force recirculation fluid exiting from the recirculation jets to intersect the dry bulk powder entering through the inlet and thoroughly wetting and mixing with any dry bulk powder that is introduced into the mixing chamber.

16. A powder mixer according to claim 12 further comprising:

said water jets located downstream relative to the recirculation jets so that they discharge water into the mixing chamber which intersects with the flow of recirculated wetted powder mixture downstream from the recirculation jets.

17. A powder mixer according to claim 16 wherein said adjustable water jets converge inwardly so that flow of mix water from said adjustable water jets converges inwardly within the mixing chamber to intersect converging flow of recirculation fluid from the recirculation jets in the mixing chamber to mix with and wet any dry bulk powder introduced into the mixing chamber.

18. A powder mixer according to claim 17 further comprising:

a rotating flow adjustment plate provided within said mixer and rotatable by means of an attached handle, said rotating flow adjustment plate provided with cut away openings therethrough, and a fixed orifice plate provided in said mixer, said fixed orifice plate provided with jet openings therethrough so that the cut away openings provided in the rotating flow adjustment plate and the jet openings provided in the fixed orifice plate cooperate to adjust the flow from the adjustable water jets.

19. A powder mixer for mixing a dry powder with liquid comprising:

a powder mixer having a dry bulk powder inlet provided at one end of the mixer, said inlet communicating with a bulk inlet chamber and subsequently with a mixing chamber provided within the powder mixer, said mixing chamber communicating with an outlet provided at an opposite end of the mixer, water jets provided annularly, said water jets provided with metering orifices that are directed inward into said mixing chamber in an unobstructed and non-axial orientation so that water exiting from the water jets via the metering orifices does not impinge on any other structure as it enters the mixing chamber, and at least one recirculation jet provided for discharging recirculated fluid into the said mixing chamber wherein said water jets are provided downstream of the at least one recirculation jet.

20. A powder mixer for mixing a dry powder with liquid according to claim 19 further comprising:

said water jets being adjustable.

21. A powder mixer for mixing a dry powder with a liquid according to claim 20 wherein the water jets are adjustable by rotating a movable flow adjustment plate provided on the mixer relative to a fixed orifice plate provided adjacent to the movable flow adjustment plate on the mixer.

22. A powder mixer for mixing a dry powder with liquid comprising:

a powder mixer having a dry bulk powder inlet provided at one end of the mixer, said inlet communicating with a bulk inlet chamber and subsequently with a mixing chamber provided within the powder mixer, said mixing chamber communicating with an outlet provided at an opposite end of the mixer, recirculation jets provided annularly so that they discharge into said mixing chamber, water jets provided annularly, said water jets provided with metering orifices that are directed inward into said mixing chamber in an unobstructed and non-axial orientation so that water exiting from the water jets via the metering orifices does not impinge on any other structure as it enters the mixing chamber, and said recirculation jets extending into the bulk inlet chamber to form a regular star polygon configuration in the mixing chamber wherein said water jets are provided downstream of the recirculation jets.

23. A powder mixer for mixing a dry powder with liquid according to claim 22 wherein said water jets are adjustable.

24. A powder mixer for mixing a dry powder with liquid according to claim 23 further comprising:

a water manifold attached to and supplying water to said water jets.

25. A powder mixer for mixing a dry powder with liquid according to claim 24 wherein an exterior surface of a wall of the inlet chamber forms one boundary of the recirculation manifold and recirculation jets.

* * * * *